US006412230B1

(12) United States Patent
Zambelli et al.

(10) Patent No.: US 6,412,230 B1
(45) Date of Patent: Jul. 2, 2002

(54) ACCIDENT-PREVENTION DEVICE FOR BUILDINGS, PARTICULARLY FOR ASSEMBLING PREFABRICATED COMPONENTS MADE OF CONCRETE OR THE LIKE

(76) Inventors: Sergio Zambelli; Benito Zambelli, both of Via Roma 44, 24050 Zanica (IT)

( * ) Notice: Subject to any disclaimer, the term of this patent is extended or adjusted under 35 U.S.C. 154(b) by 0 days.

(21) Appl. No.: 09/645,560

(22) Filed: Aug. 24, 2000

(30) Foreign Application Priority Data

Sep. 9, 1999 (IT) ..... MI99A1900

(51) Int. Cl.[7] ..... A47L 3/04

(52) U.S. Cl. ..... 52/27; 52/DIG. 12; 182/3; 182/113; 404/6

(58) Field of Search ..... 52/27, DIG. 12; 404/6; 182/3, 113

(56) References Cited

U.S. PATENT DOCUMENTS 1,633,112 A * 6/1927 Kulbeck ..... 182/113
1,713,956 A * 5/1929 Diven ..... 182/3
2,237,543 A * 4/1941 Berchem et al. ..... 52/27
2,725,853 A * 12/1955 Nordheim ..... 182/3
4,045,003 A * 8/1977 McCluskey et al. ..... 256/59
4,598,503 A * 7/1986 Berger et al. ..... 52/27
5,297,651 A * 3/1994 Vandelinde ..... 182/3
5,350,037 A * 9/1994 Ghahremani ..... 182/3
5,358,068 A * 10/1994 Whitmer ..... 182/113
5,398,777 A * 3/1995 Ouellette et al. ..... 182/3
5,458,214 A * 10/1995 Olson et al. ..... 182/18
5,699,875 A * 12/1997 Dugan ..... 182/3

* cited by examiner

*Primary Examiner*—Carl D. Friedman
*Assistant Examiner*—Phi Dieu Tran A
(74) *Attorney, Agent, or Firm*—Guido Modiano; Albert Josif; Daniel O'Byrne

(57) ABSTRACT

An accident-prevention device for buildings, particularly for assembling prefabricated components made of concrete, which comprises at least one pole and elements for detachably connecting the base of the pole to the surface of a building. The pole has, proximate to its tip, guiding pulleys for a cable element which forms a safety parapet. The guiding means are adapted to divert, in a direction which is substantially parallel to the axis of the pole, at least part of the stresses transmitted from the cable element to the pole, and the pole is provided with shock-absorbing elements for cushioning the stresses transmitted from the cable element to the pole in a direction which is substantially parallel to the axis of the pole.

44 Claims, 9 Drawing Sheets

ACCIDENT-PREVENTION DEVICE FOR BUILDINGS, PARTICULARLY FOR ASSEMBLING PREFABRICATED COMPONENTS MADE OF CONCRETE OR THE LIKE

BACKGROUND OF THE INVENTION

The present invention relates to an accident-prevention device for buildings, particularly for assembling prefabricated components made of concrete or the like, which are designed to provide individual protection against falls of workers assigned to walking high above ground level on buildings being erected.

Such devices generally comprise a plurality of spaced metal poles which are connected, at their base, to a horizontal surface of the building, formed for example by a beam, and have, at their tip or in an intermediate region of their vertical extension, a passage for a cable which is fixed to the building at its ends and is tensioned by means of appropriate cable tensioning elements so as to form a safety parapet.

In these devices, the poles are designed only to keep the cable at a preset height so that it can be easily engaged by the spring-catches with which the safety belts or harnesses worn by workers are equipped.

In some accident-prevention devices, the poles are inserted in a cavity which is formed inside a concrete component of the building.

In other devices, the poles are provided with a threaded base which can be engaged in a female thread formed inside a bushing which is embedded beforehand into the concrete component.

In other devices, the poles are rigidly coupled to the concrete component by a bayonet coupling, such as for example the device disclosed in U.S. Pat. No. 4,045,003.

In these devices, the load-bearing function is mainly performed by the cable, which discharges the stresses produced by a fall of the worker mainly onto the building to which it is coupled at its ends.

The need to couple the ends of the cable to the building entails the problem of having, on the building, regions that cannot be protected, i.e., the regions that lie between the end poles of the row of poles and the region where the cable is anchored to the building, which is usually located on the same surface that supports the poles. In these regions the cable, by following an inclined path from the tip of the end pole to the surface that supports the poles, cannot be used as a fastening for safety harnesses or belts.

In some devices, the ends of the cable, instead of being anchored directly to the building, are anchored to the end poles. In this case, since they must withstand higher stresses, the end poles are provided with lateral supports or have a structure which is considerably bulkier than the other poles and in practice prevent access to the region of the building located in the immediate vicinity, in any case reducing the length of the cable that can actually be used as a fastening for safety belts or harnesses.

Many conventional safety devices have shock absorbers designed to reduce the peaks of the stresses discharged onto the cable and, by reaction, onto the worker when he falls.

The shock absorbers are usually constituted by springs arranged along the cable or between the cable and a pole or between the cable and the element for anchoring one end of the cable to the building.

Although these shock absorbers reduce the peaks of the stresses discharged onto the worker and onto the cable, they have a limited effect in reducing the peaks of the stresses discharged onto the end poles in a direction which is substantially transverse to the axis of the poles, if the cable is connected to said end poles with its ends.

Because of this, despite the presence of the shock absorbers, the end poles must be either provided with lateral supports, generating the above described problems, or oversized, with consequent cost increases.

SUMMARY OF THE INVENTION

The aim of the present invention is to solve the above problems, by providing an accident-prevention device for buildings, particularly for assembling prefabricated components made of concrete or the like, which allows to significantly reduce the stresses transmitted from the cable to the pole transversely to the axis of the pole, thereby avoiding or at least limiting the need to oversize the poles.

Within the scope of this aim, an object of the invention is to provide a device which allows to distribute over a plurality of poles the stresses that are transmitted along the cable, thus reducing the stresses discharged onto each pole.

Another object of the invention is to provide a device which also significantly reduces the peaks of the stresses which, by reaction, are transmitted to the user in case of a fall.

Another object of the invention is to provide a device which allows to protect substantially all the area of a building to which it is applied.

Another object of the invention is to provide a device which allows to arrange the cable even along a path having one or more lateral changes of direction.

Another object of the present invention is to provide a device which is highly reliable and can be manufactured at competitive costs.

These and other objects which will become better apparent hereinafter are achieved by an accident-prevention device for buildings, particularly for assembling prefabricated components made of concrete, which comprises at least one pole and means for detachably connecting a base of said pole to a surface of a building; said pole having, proximate to a tip thereof, guiding means for a cable element which forms a safety parapet, characterized in that said guiding means are adapted to divert, in a direction substantially parallel to the axis of said pole, at least part of the stresses transmitted from said cable element to said pole, and in that said pole is provided with means for cushioning the stresses transmitted from said cable element to said pole in a direction which is substantially parallel to the axis of the pole.

BRIEF DESCRIPTION OF THE DRAWINGS

Further characteristics and advantages of the invention will become better apparent from the following detailed description of some preferred but not exclusive embodiments of the device according to the invention, illustrated only by way of non-limitative example in the accompanying drawings, wherein:

FIG. 1 is a lateral elevation view of the device according to the present invention;

FIG. 2 is a partially sectional lateral elevation view of a pole of the device according to the invention;

FIG. 3 is an enlarged-scale view of the pole of FIG. 2;

FIGS. 4 to 9 are views of the sequence for anchoring a pole of the device according to the invention to the surface of a building;

FIG. 10 is an enlarged-scale top plan view of a pole of the device according to the invention;

FIG. 11 is an enlarged-scale view of the pole, taken along the line XI—XI of FIG. 2;

FIG. 13 is a partially sectional lateral elevation view of a pole of the device according to the invention;

FIG. 14 is a perspective view of the pole of FIG. 13, illustrating the possibility to secure one end of the cable element on the pole;

FIG. 15 is a sectional view of FIG. 13, taken along the line XV—XV;

FIG. 16 an enlarged-scale sectional view of the pole of FIG. 13, in one of its operating conditions;

FIG. 17 is a view of the same detail of FIG. 16, in another operating condition;

FIG. 18 is an enlarged-scale sectional view of FIG. 16, taken along the line XVIIII–XVIII.

DESCRIPTION OF THE PREFERRED EMBODIMENTS

Figure 1:
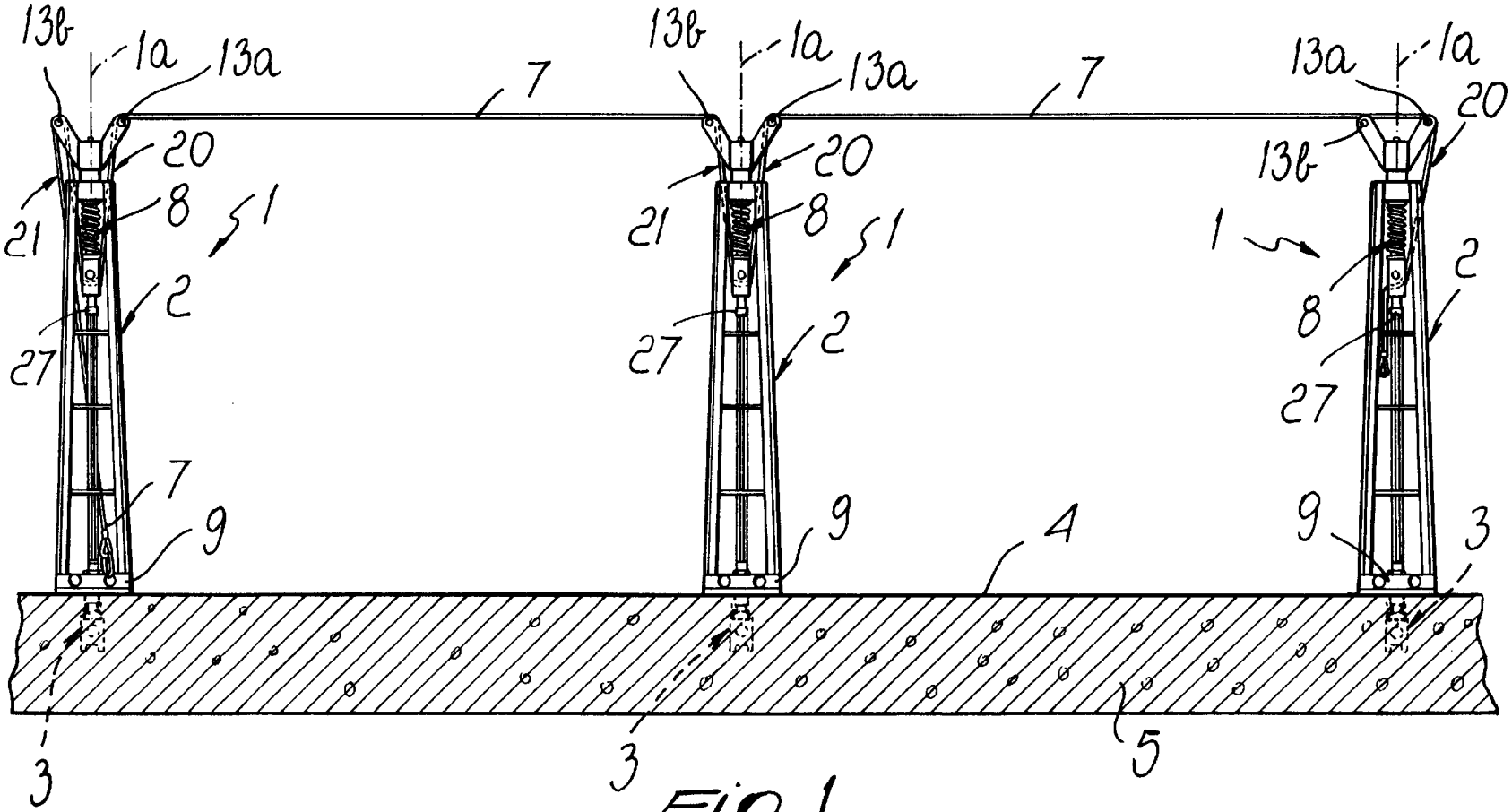
FIGS. 1 to 11 are views of the device according to the invention in a first embodiment, and more particularly.
Figure 2:
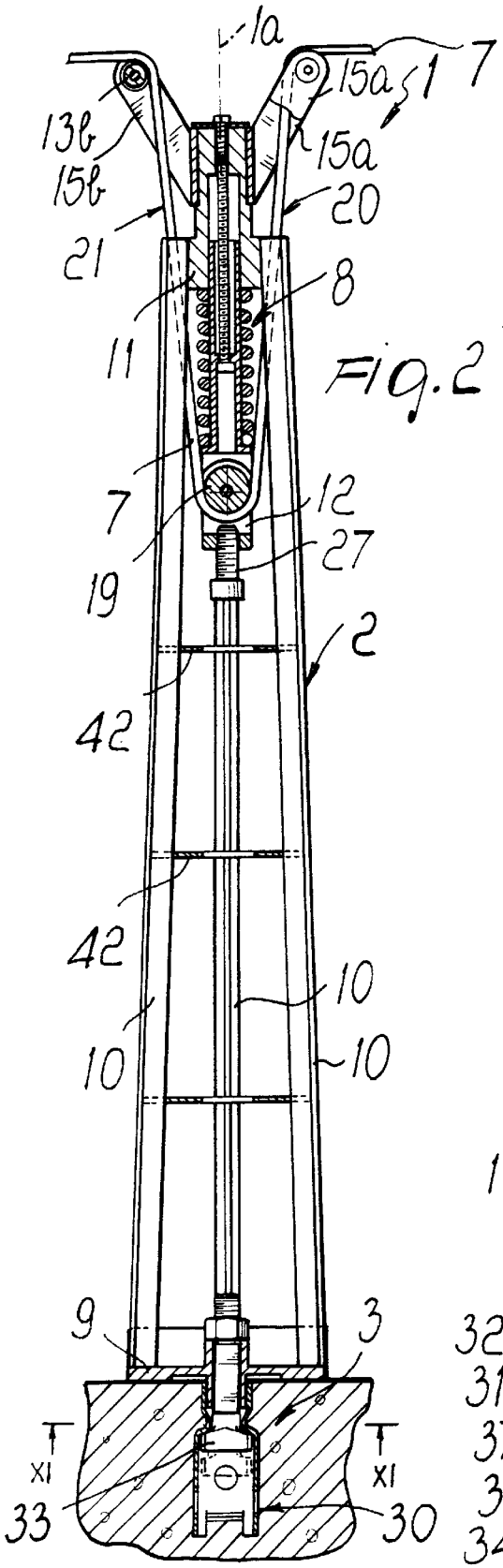
Figure 3:
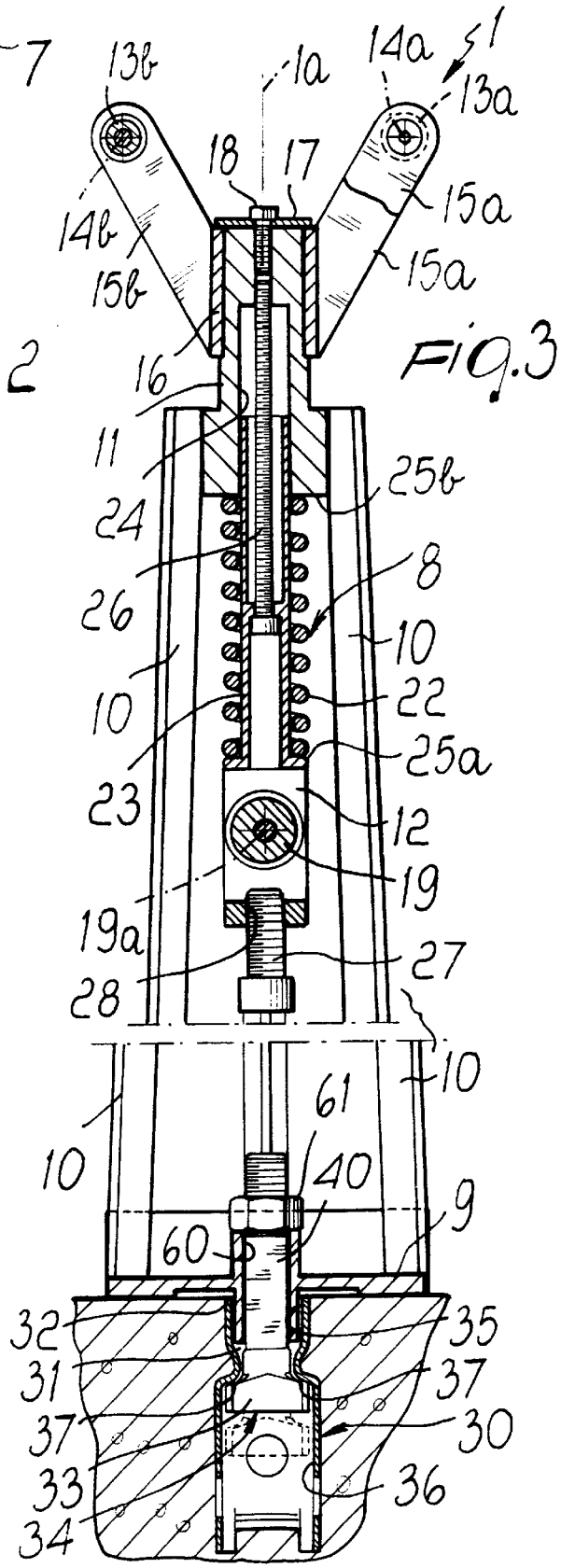

With reference to FIGS. 1 to 12, the device according to the invention comprises at least one pole, generally designated by the reference numeral 1, which has a main structure 2 which can be detachably fixed with its base, by virtue of connection means 3, to a surface of a building 4 which is formed for example by a beam 5. The pole 1 has, proximate to its tip, guiding means for a cable element 7 which forms a safety parapet.

According to the invention, the guiding means are adapted to redirect, in a direction which is substantially parallel to the axis 1*a* of the pole 1, at least part of the stresses that are transmitted from the cable element 7 to said pole, and the pole 1 has shock-absorbing means.8-for damping the stresses transmitted by the cable element 7 to the pole 1 in a direction which is substantially parallel to the axis 1*a* of the pole.

More particularly, the base of the pole 1 is constituted by a base plate 9 resting with its lower face on the surface 4, and the main structure 2 of the pole is preferably constituted by sections 10, for example having a T-shaped or H-shaped cross-section, which are spaced around the axis 1*a* of the pole and rigidly connect the base plate 9 to a tip element 11 which constitutes the tip of the pole 1.

In order to strengthen the main structure 2, it is possible to provide, along the vertical extension of the pole 1, a series of horizontal stiffening plates 42 which are spaced in a vertical direction and are rigidly connected, for example by welding, to the sections 10.

The guiding means comprise guides for the cable element 7 which form, proximate to the tip of the pole, a portion of path of said cable element 7 which has a component which is parallel to the axis 1*a* of the pole.

At least one of the guides is mounted on a supporting element 12, which can move with respect to the main structure 2 in a direction which is substantially parallel to the axis 1*a*. The shock-absorbing means 8 are interposed between the main structure 2 and the supporting element 12.

Conveniently, the guides comprise a pair of lateral pulleys 13*a* and 13*b* which are associated with the main structure 2 and are arranged so that their axes 14*a* and 14*b* are parallel, substantially at right angles to the axis 1*a*, and are laterally spaced on opposite sides with respect to the axis 1*a*.

Preferably, the pulleys 13*a* and 13*b* are supported, so that they can rotate about their respective axes 14*a* and 14*b*, by two pairs of wings 15*a* and 15*b* which are associated with the tip element 11. More particularly, two wings 15*a* are provided, which are arranged side by side and support the pulley 13*a*, and two wings 15*b*, also arranged side by side, which support the pulley 15*b*.

Preferably, the wings 15*a* and 15*b* are rigidly fixed to the lateral surface of a sleeve 16 which is supported by the tip element 11 so that said sleeve can rotate-about its own axis, which coincides with the axis 1*a*.

As shown, the sleeve 16 can be interposed between an axial shoulder, provided on the outer surface of the tip element 11, and a washer 17 which is locked by means of a screw 18 at the upper end of the tip element 11.

In this manner, the sleeve 16, and therefore the pairs of wings 15*a* and 15*b*, can rotate with respect to the tip element 11 about the axis 1*a* so as to allow lateral changes of direction of the path for the cable element 7.

The above cited guides comprise, in addition to the pulleys 13*a* and 13*b*, an intermediate pulley 19 which is arranged so that its axis 19*a* lies parallel to the axes 14*a* and 14*b* of the pair of pulleys 13*a* and 13*b* and is arranged between the pulleys 13*a* and 13*b* . Moreover, the intermediate pulley 19 is spaced from the pair of pulleys 13*a* and 13*b* in a direction substantially parallel to the axis 1*a* in order to guide the cable element 7 from the pair of pulleys 13*a* and 13*b* to the intermediate pulley 19 along two path portions, indicated by the arrows 20 and 21, which have a component which is parallel to the axis 1*a* of the pole.

The supporting element 12, on which the intermediate pulley 19 is fitted, is supported by the main structure 2 so that it is movable along the axis 1*a* of the pole, and the shock-absorbing means 8 are interposed between the main structure 2 and the supporting element 12.

The shock-absorbing means 8 can be constituted, as shown, by a spring 22, for example a helical spring orientated so that its axis is parallel to the axis 1*a*, or can also be constituted by a hydraulic or pneumatic shock absorber which is interposed between the main structure 2 and the supporting element 12.

Figure 12:
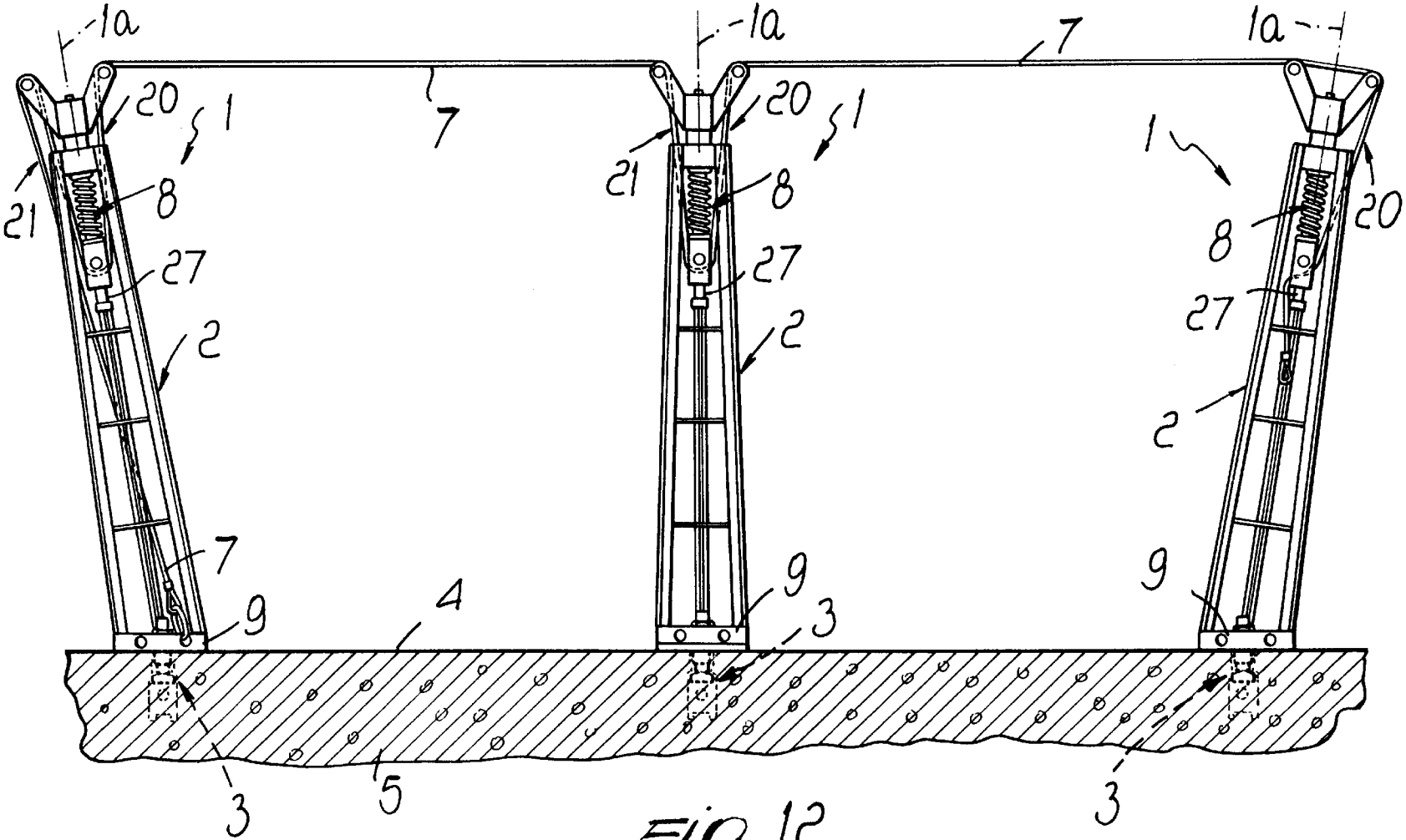
FIG. 12 is a view of a different embodiment of the device according to the invention, in which the end poles are inclined with respect to the vertical.

Preferably, the pole 1 is arranged so that its axis 1*a* lies substantially vertically or is inclined with respect to the vertical, particularly if it is designed to be an end pole of a row of poles, as shown in FIG. 12, and the pulleys 13*a* and 13*b* are arranged at a same elevation which is higher than the elevation of the intermediate pulley 19.

The supporting element 12 is provided with a sleeve 23 whose axis preferably coincides with the axis 1*a* of the pole and is coupled, so that it is slideable along its own axis, to a coaxial sliding seat 24 which is formed in the tip element 11.

The spring 22 is fitted around the sleeve 23 and engages, with one of its ends, against a shoulder 25*a* formed by the supporting element 12 and, with its other end, against a shoulder 25*b* which is formed by the tip element 11 around the inlet of the sliding seat 24.

Conveniently, means are provided for delimiting the sliding of the sleeve 23 along the sliding seat 24. Said means for delimiting the sliding of the sleeve 23 along the sliding seat 24 comprise a traction element 26 which is accommodated within said sleeve 23 and engages, for example by means of a threaded coupling, the tip element 11. The traction element 26 connects the supporting element 12 and the tip element 11 and delimits the sliding of the sleeve 23 away from the tip element 11 produced by the action of the spring 22.

It should be noted that the sleeve 23 is coupled, in the sliding seat 24, so that it can rotate about its own axis so as to allow the intermediate pulley 19 to rotate, together with the pair of pulleys 13*a* and 13*b*, about the axis 1*a* of the pole in order to allow the cable element 7 to perform any lateral changes in direction.

Conveniently, means are provided for securing the cable element 7 to the supporting element 12. Said securing means are preferably constituted by a screw-type clamping element 27 which couples to a threaded hole 28 formed in the supporting element 12 and can be operated so as to clamp the cable element 7 between the pulley 19 and said clamping element 27. The clamping element 27 can be actuated or deactivated according to the requirements, as will become apparent hereinafter.

Preferably, the main structure 2 of the pole 1 has a shape which tapers from its base toward its tip.

The connection means 3 comprise an anchoring element 30 which can be fixed to the surface 4 of the building and forms a female seat 31 which lies along an axis which is substantially perpendicular to the surface 4 and has an access opening 32 formed in said surface 4 of the building. Said female seat 31 can be detachably coupled to a male-shaped end 33 of a securing element 34 which protrudes from the base of the main structure 2 of the pole 1.

The female seat 31 has, starting from the access opening 32, a first portion 35, which can be crossed by the male-shaped end 33 which moves axially with respect to the female seat 31, and a second portion 36 which forms, at its end directed toward the first portion 35, at least one axial shoulder 37 which can be engaged by the male-shaped end 33 by a partial rotation of the securing element 34 about the axis of the female seat 31 and by means of an axial translatory motion of the securing element 34 in the opposite direction with respect to the insertion direction relative to the female seat 31.

Substantially, the securing element 34 can turn about the axis of the female seat 31 with respect to said female seat 31 through a preset angle, preferably 90°, in order to transfer its male-shaped element 33 from an insertion position, in which it can pass through the first portion 35 and move laterally beyond the axial shoulder 37, to an engagement position, in which it faces, with the male-shaped end 33, the axial shoulder 37.

Conveniently, the anchoring element 30 is constituted by a tubular body, preferably made of steel, which internally forms the female seat 31. Said tubular body has an axial end which is open so as to form the access opening 32 and, in an intermediate region of its extension, at least one raised portion which protrudes from its internal surface and covers a limited arc around the axis of the female seat 31, so as to form said axial shoulder 37.

Preferably, the first portion 35 is obtained by means of a compression of the end with the access opening 32 of the tubular body 30 which gives the first portion 35 a non-circular shape. The transverse cross-section of the non-circular shape can be, according to the requirements, a rectangular, elliptical, rhomboidal one or another adapted one.

The compression that forms the first portion 35 at the same time forms the shoulder 37. In the illustrated case, compression is applied to two diametrically opposite regions of the tubular body 30 and forms two axial shoulders 37.

The second portion 36 of the tubular body 30 preferably has a cylindrical shape.

It should be noted that the second portion 36 of the tubular body 30 may also be shaped like a cylindrical sector or sectors, so as to allow the male-shaped element 33 to turn in any case about the axis of the tubular body 30 after passing from the first portion 35 to the second portion 36.

The male-shaped end 33 is shaped complementarily to the first portion 35 of the female seat 31.

The male-shaped end 33 is constituted by the lower end of a shaft 40 whose axis lies at right angles to the face of the base plate 9 that rests on the surface 4 and has a diameter which is smaller than the minimum transverse dimension of the first portion 35 of the female seat 31.

The lower end of the shaft 40, which constitutes the male-shaped end 33, has two lateral protrusions, in two diametrically opposite regions, which form two axial shoulders 41 which can engage the axial shoulders 37 of the female seat 31.

The locking element 34 is rigidly coupled to the main structure 2 of the pole 1 in rotating about the axis of the female seat 31, and is movable with respect to the main structure 2 along the female seat 31 so as to engage, by means of the axial shoulders 41, against the axial shoulders 37 of the female seat 31 after its male-shaped end 33 has been inserted in the female seat 31 until it lies below the axial shoulders 37 and has been turned through 90° about the axis of said female seat 31.

The shaft 40 passes, so that it is slideable along its own axis, through a passage 60 which crosses the base plate 9, and the translatory motion of the shaft 40 along the axis of the female seat 31 in order to achieve the engagement of the axial shoulders 41 against the axial shoulders 37 of the female seat 31 can be achieved by providing the upper end of the shaft 40, i.e., its end that lies opposite the male-shaped end 33, so that it is threaded and coupled to an adjustment nut 61 which rests on the upper face of the base plate 9 or in any case against a shoulder formed on the upper face of the base plate 9.

Conveniently, the main structure 2 of the pole 1 has, on its base, a protrusion 50 which can engage a seat formed in the surface 4 of the building only as a consequence of the insertion of the male-shaped end 33 of the securing element 34 in the female seat 31 and as a consequence of the transfer of the securing element 34 from the insertion position to the engagement position cited above.

Preferably, the protrusion 50 lies around the male-shaped end 33 of the securing element 34 and is shaped complementarily to the first portion 35 of the female seat 31.

Substantially, the configuration of the protrusion 50 is very similar to the configuration of the male-shaped end 33, but is rotated with respect to it through 90°.

The protrusion 50 can be formed monolithically or otherwise rigidly coupled to the base plate 9, protruding from the lower face thereof. The passage 60 passes through the protrusion 50 and the shaft 40 and is rigidly coupled, in rotation about its own axis, to the protrusion 50 and to the base plate 9. The shaft 40 in fact has an axial portion which couples to the passage 60 and has a non-circular transverse cross-section complementary to the transverse shape of the passage 60. The portion of the shaft 40 that engages the passage 60 can be, according to the requirements, rectangular, square, splined, star-shaped, or otherwise suitably shaped.

In the embodiment shown in FIGS. 13 to 18, the device according to the invention comprises at least one pole 101 which is similar to the pole 1 already described with reference to the embodiment shown in the preceding figures.

The elements of the pole 101 that correspond to the elements of the pole 1 that have already been described have been designated by reference numerals incremented by 100 with respect to the reference numerals of the corresponding elements of pole 1, and for the sake of simplicity only the differences of the pole 101 with respect to the pole 1 are indicated hereinafter. The anchoring of the pole 101 to the surface 4 of the building can again be performed by means of an already described anchoring element 30.

Conveniently, the main structure 102 of the pole 101 is constituted by a lattice-like box-shaped structure which again tapers upwards. By virtue of this fact, the internal part of the pole 101 is freer and a membrane-like behavior of the pole 101 in withstanding the stresses applied to it by the cable element 7 is achieved.

The base of the main structure 102 of the pole 101, constituted by a plate 109, has a rectangular plan shape in order to better utilize the inertia of the pole in the direction in which the cable element 7 pulls, furthermore reducing the space occupation of the base of the pole 101 transversely with respect to the beam 5.

Advantageously, the pole 101 is provided with means for preventing the accidental disengagement of the cable element 7 with respect to the lateral pulleys 113*a*and 113*b*. Such means comprise an extension of the pairs of wings 115*a*and 115*b*above the pulleys 113*a*and 113*b*so as to form two opposite lateral shoulders for the cable element 7. The pairs of wings 115*a*and 115*b*are also joined, above the pulleys 113*a*and 113*b*, by pivots 170 whose axes are parallel to the axes of the pulleys 113*a*and 113*b*; said pivots prevent the cable element 7 from climbing over the wings 115*a*and 115*b*.

The means for preventing the disengagement of the cable element 7 with respect to the lateral pulleys 113*a*and 113*b*also comprise a central groove 171, in addition to conical flared portions of the cylindrical sides of the pulleys 113*a*and 113*b*, adapted to partially accommodate the cable element 7.

Conveniently, as an alternative to the means for securing the cable element 7 on the intermediate pulley 19 of the embodiment shown in FIGS. 1 to 12, there are means for securing the cable element 7 on the main structure 102 of the pole 101. The securing means comprise a clamp 172 which is associated, for example by means of two screws 173, with the main structure 102 of the pole 101 and can be actuated in order to clamp one end of the cable element 7 to the main structure 102 of the pole 101, thus leaving the intermediate pulley 119 free to rotate. In this manner, even on the pole 101 on which one end of the cable element 7 is secured, both pulleys 113*a*and 113*b*can rotate and the shock-absorbing means 108 act symmetrically, centering on the axis of the pole 101 the stresses transmitted to said pole 101 by the cable element 7.

Advantageously, the pole 101 has means for pre-loading the shock-absorbing means 108. The pre-loading means comprise an adjustment screw 174 which is arranged so that its axis is parallel to, or coincides with, the axis 101*a*of the pole 101 and is supported, so that it is rotatable about its own axis, by the tip element 111 of the pole 101. The screw 174 engages a threaded seat formed in the supporting element 112. By turning the adjustment screw 174 in one direction it is possible to move the supporting element 112 upward, i.e., closer to the tip element 111 of the pole 101, reducing the distance of the pulley 119 from the pulleys 113*a* and 113*b* and compressing the spring 122. By turning the adjustment screw 174 in the opposite direction, the supporting element 112 is lowered and therefore the pulley 119 is moved away from the pulleys 113*a* and 113*b*, extending the spring 122. The means for pre-loading the spring 122 can be used to tension the cable element 7 during the assembly of the device, as will become apparent hereinafter.

Conveniently, furthermore, the portion of the shaft 140 that engages the passage 160 and the passage 160 have a rectangular or elliptical transverse cross-section, so as to ensure correct orientation of the shaft 140 about its own axis with respect to the protrusion 150 and therefore to the main structure 102 of the pole 101 during the insertion of the pole 140 in the passage 160.

Installation of the device according to the invention is as follows.

First of all, the poles 1 are installed by using the female seats 31 formed beforehand in the surface 4 during the provision of surface 4 by embedding the tubular body that constitutes the anchoring element 30 in the concrete casting that forms the surface 4.

Figures 4, 5, 6:
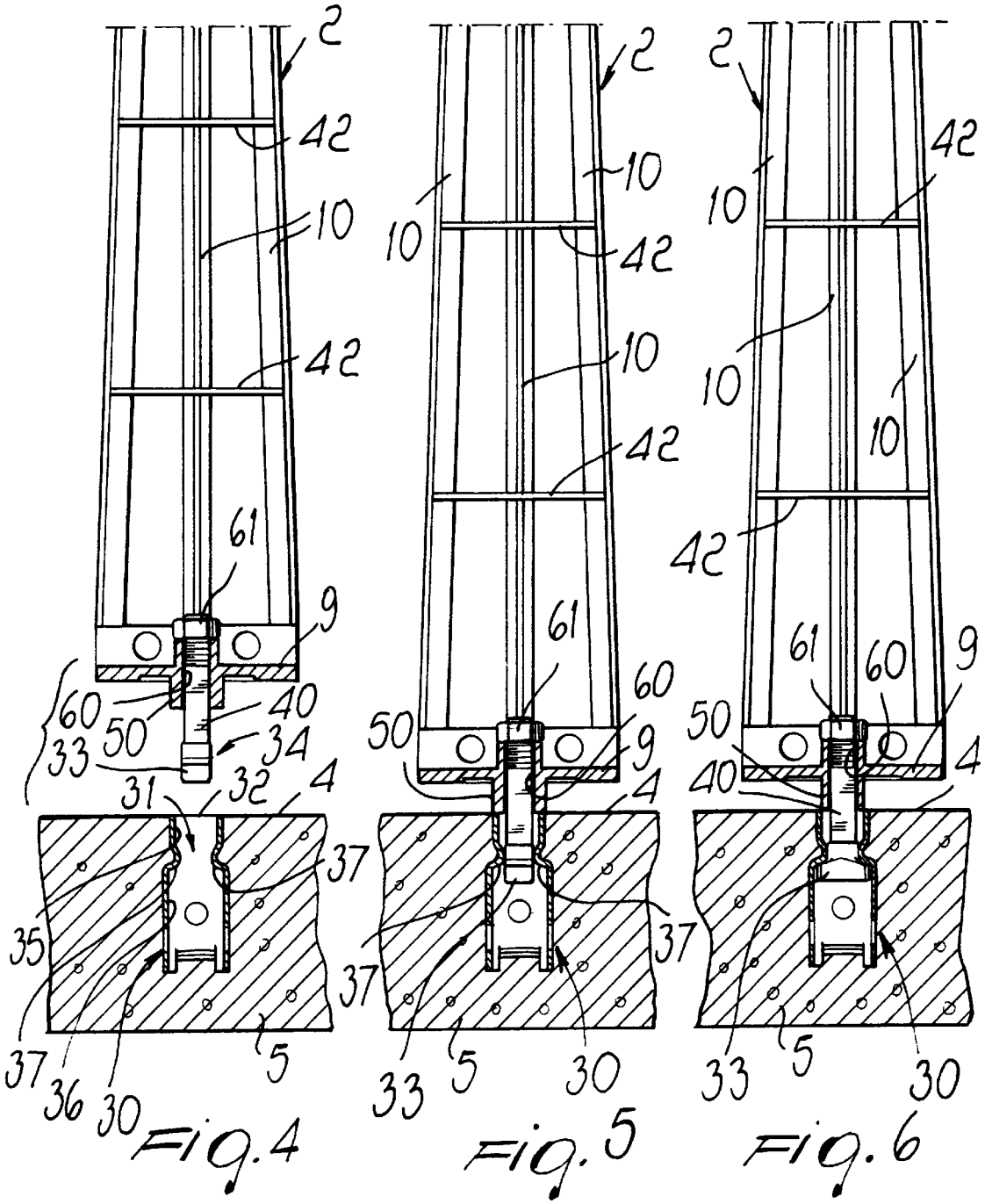

As shown in FIGS. 4 and 5, the pole 1 is arranged vertically so that the male-shaped end 33 is orientated so that it corresponds to the access opening 32 and can enter the female seat 31 by passing through the first portion 35 and reach the second portion 36, passing beyond the axial shoulders 37.

As shown in FIGS. 4 and 5, in this position the protrusion 50, by being rotated with respect to the male-shaped end 33 through an angle of substantially 90°, rests on the edges of the access opening 32 and cannot enter the female seat 31.

Figure 7:
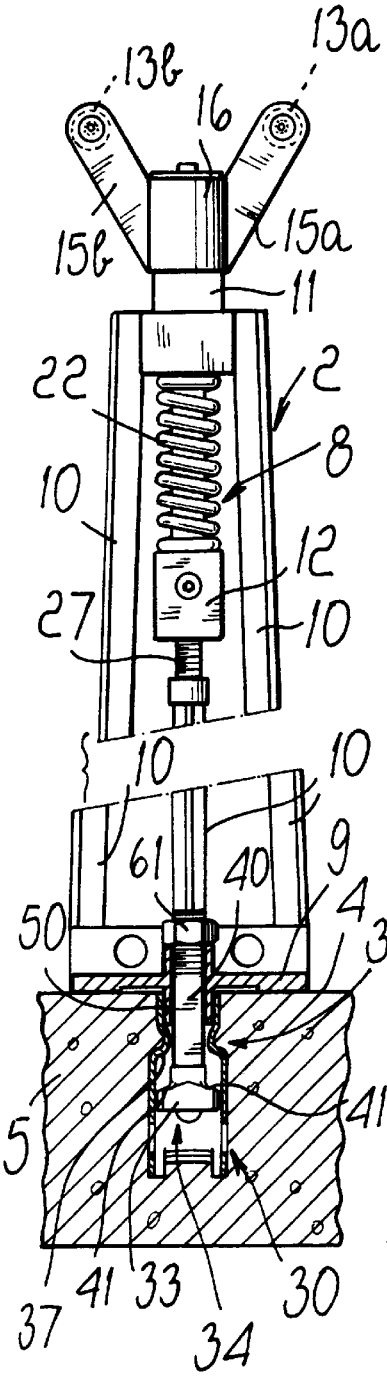

The pole 1 is then turned about the axis of the female seat 31 through an angle of 90° (FIG. 6), so that the male-shaped end 33 faces, with its axial shoulders 41, the axial shoulders 37. This rotation also causes the insertion of the protrusion 50 in the first portion 35 of the female seat 31, as shown in FIG. 7.

It should be noted that the correct rotation of the pole 1 about the axis of the female seat 31, which brings the male-shaped end 33 into the correct position for locking with respect to the axial shoulders 37, is indicated unequivocally to the worker by the descent of the pole 1, with the protrusion 50, into the first portion 35 of the female seat 31, which also achieves the complete resting of the base of the pole 1 on the surface 4.

Figure 8:
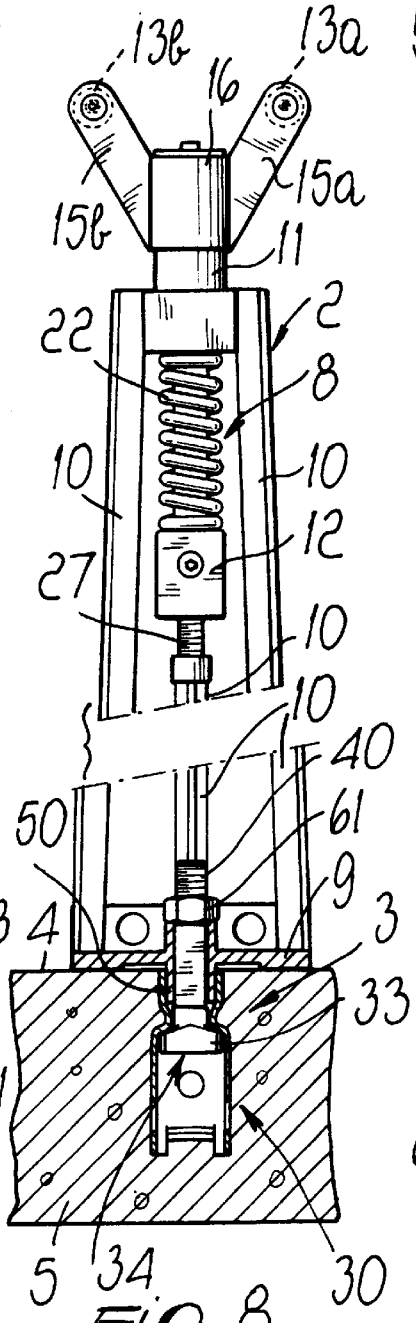
Figure 9:
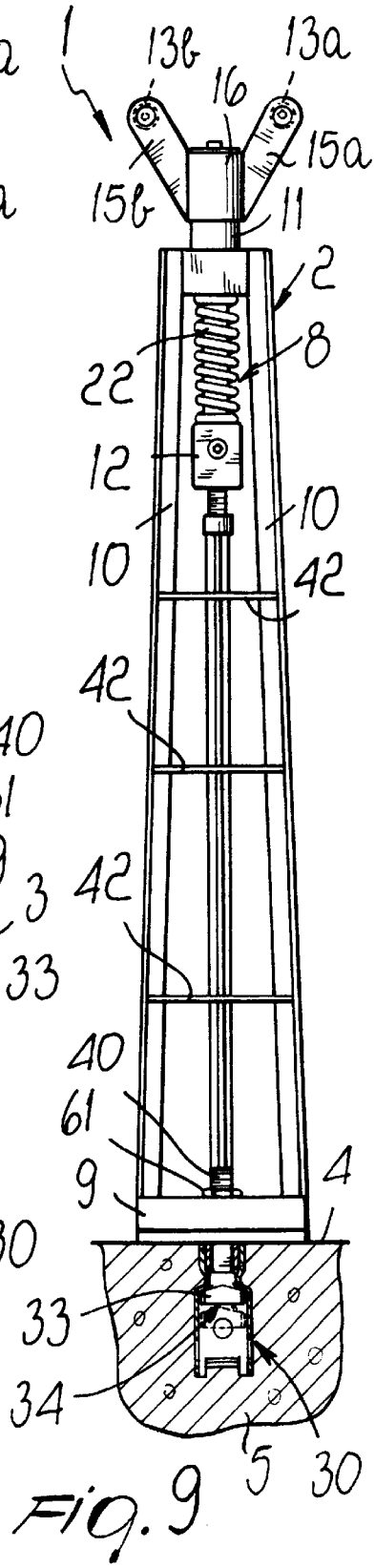
Figure 10:
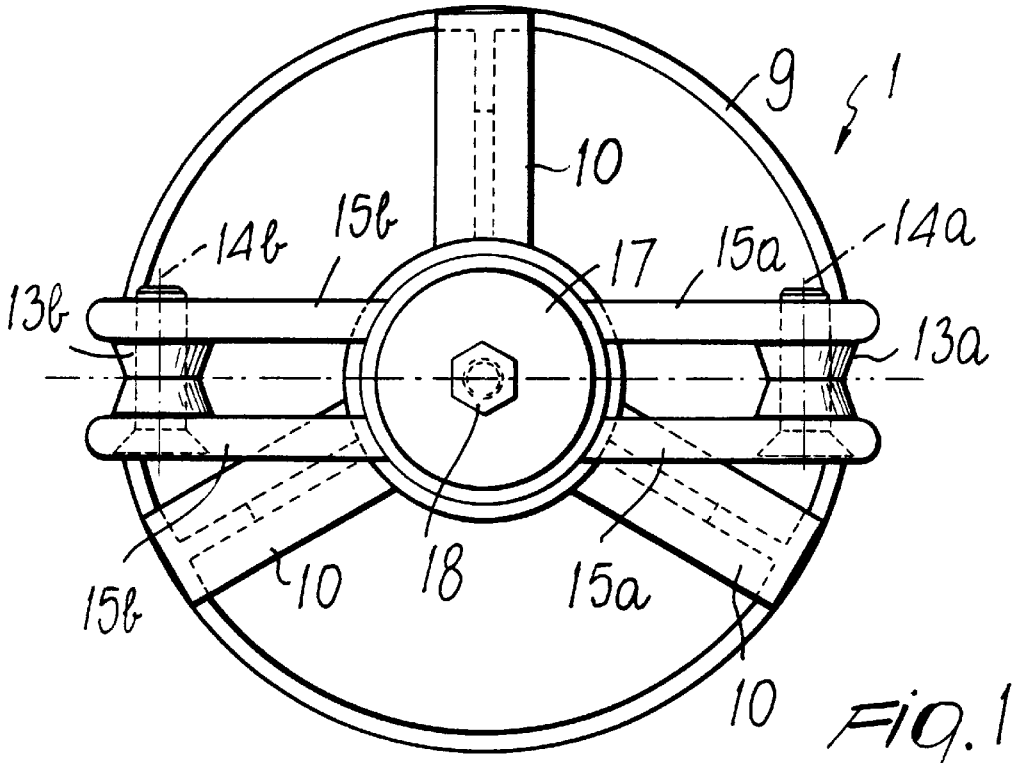
Figure 11:
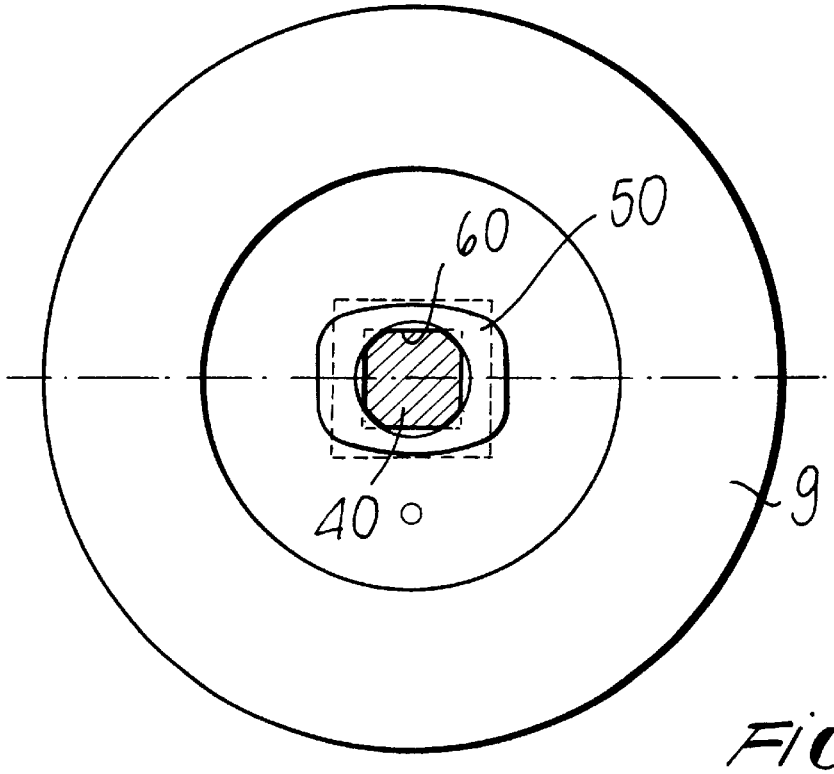

At this point the worker, by acting on the adjustment nut 61, causes the upward movement of the male-shaped end 33, which engages against the axial shoulders 37, firmly locking the pole 1 against the surface 4, as shown in FIG. 8.

The poles 101 of the type shown in FIGS. 13 to 18 are installed in a manner similar to the one described with reference to the poles 1.

Figure 14:
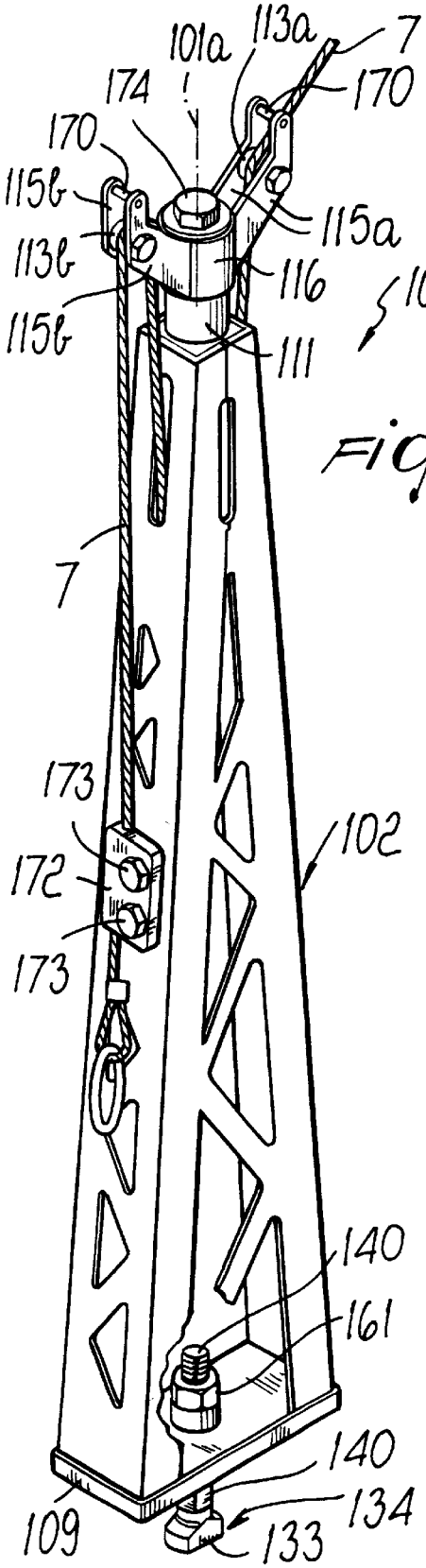
FIGS. 13 to 18 are views of a second embodiment of the device according to the invention, and more particularly.
Figure 13:
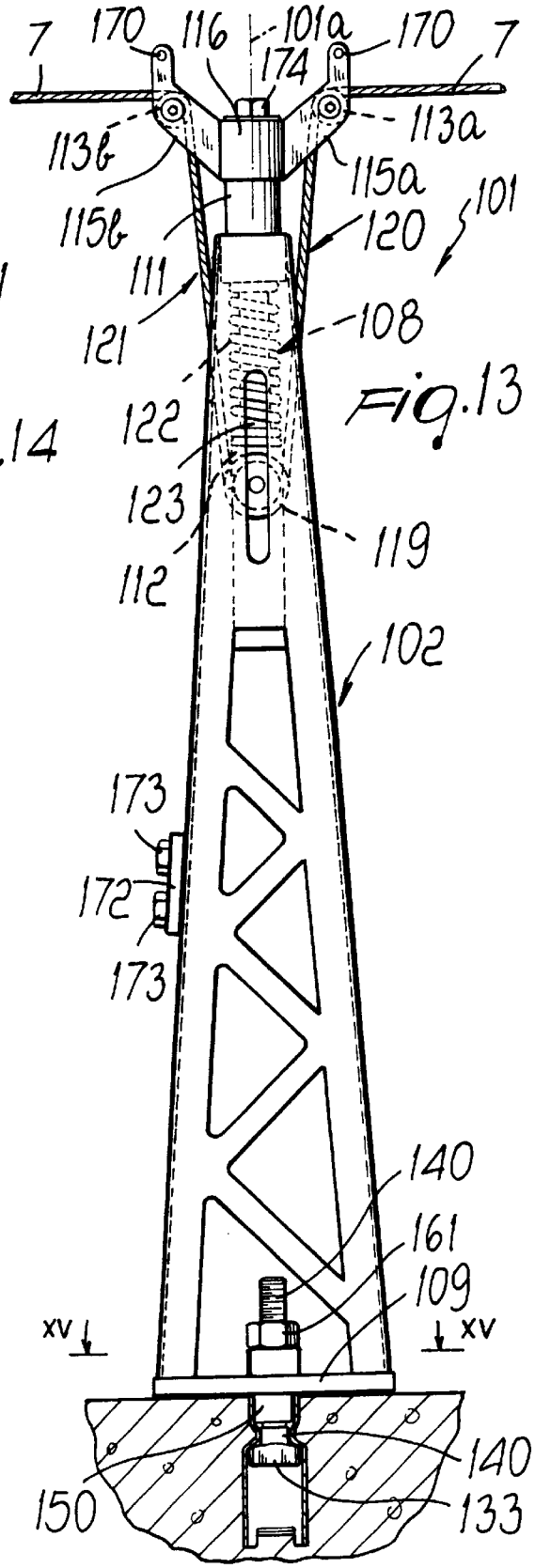
Figure 15:
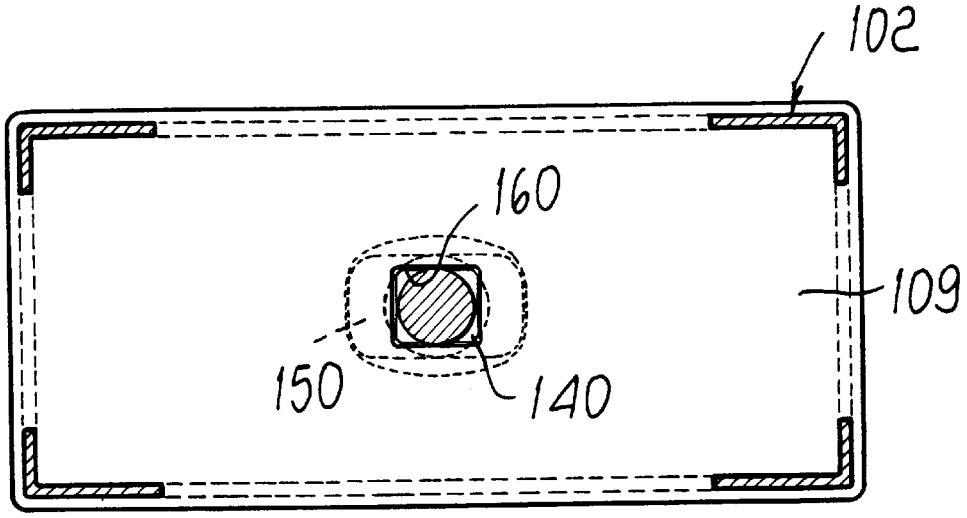
Figure 18:
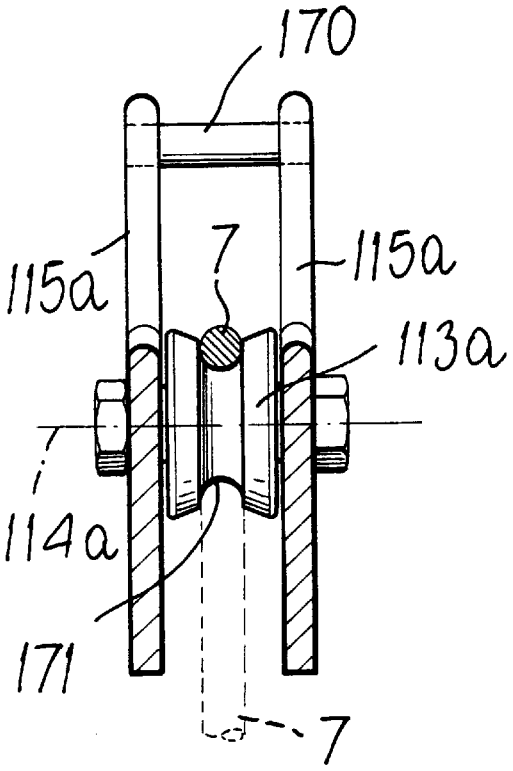

Once the installation of the poles 1, 101 as described has been completed, a cable element 7 is passed over the pairs of pulleys 13*a*, 113*a*and 13*b*, 113*b*and under the intermediate pulleys 19, 119 of the various poles 1, 101. The cable element 7 is then rigidly coupled to the end poles and tensioned either manually or with the aid of conventional winches. One end of the cable element can be coupled to the main structure 2 of an end pole by means of a loop or by means of the clamp 172, while the other end can be anchored to a winch located on the other end pole or secured by means of the clamping element 27, as shown in FIGS. 1, 12 and 14.

Figure 17:
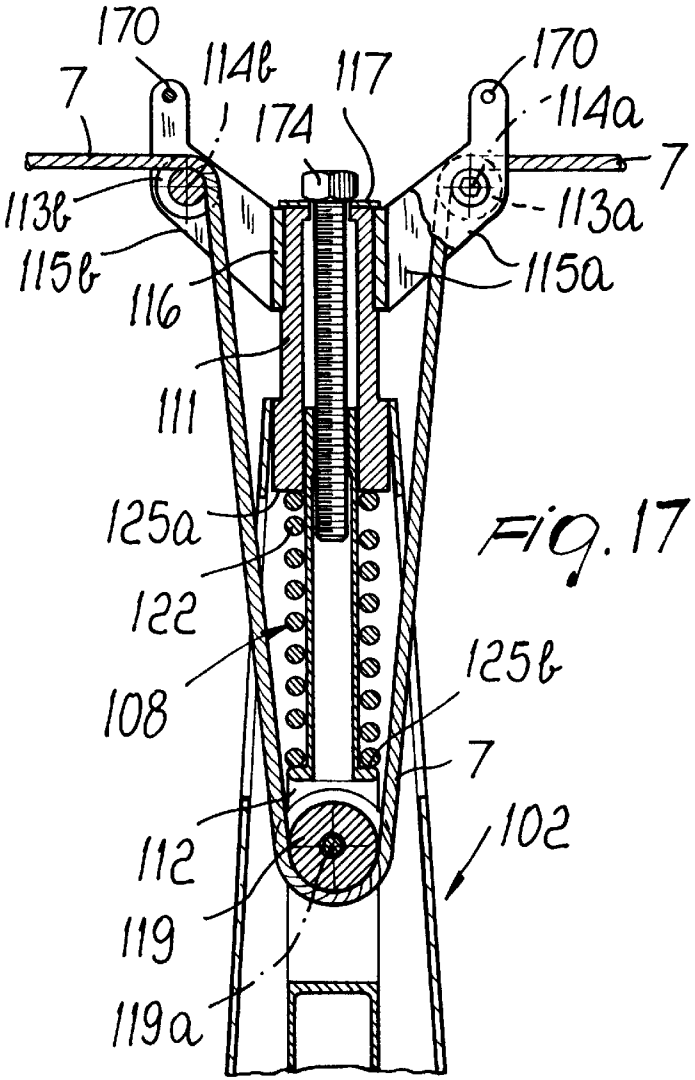
Figure 16:
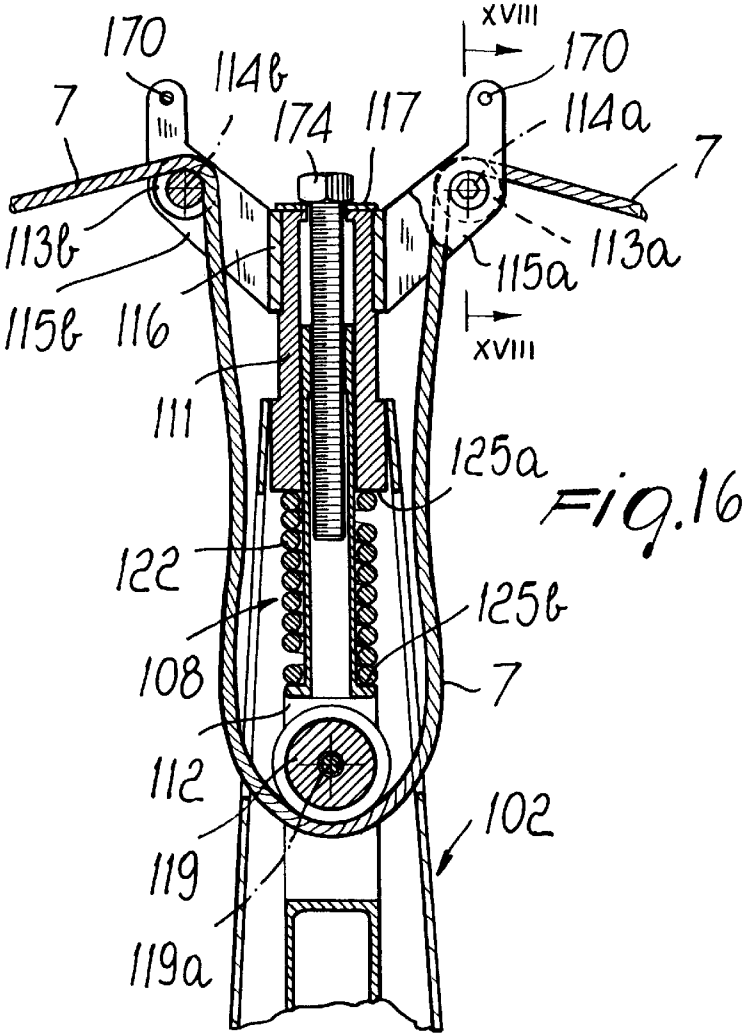

It should be noted that the cable element 7, with the poles 101, can also be tensioned by pre-loading the springs 122 of the various poles 101 by means of the adjustment screws 174 before securing the ends of the cable element 7 to the end poles 101 or, better still, before passing the cable element 7 over the pulleys 113*a*, 113*b* and 119, as shown in FIG. 16. After securing the ends of the cable element 7 on the end poles 101 by means of the clamps 172, the springs 122, by virtue of the adjustment screw 174, are partially or fully released, thus tensioning by the required extent the cable element 7 as shown in FIG. 17.

The workers can thus engage their safety harnesses or belts to the portions of the cable element 7 that lie between two contiguous poles.

Should a worker fall, the stress produced by the fall is transmitted from the cable element 7 to the various poles and its direction is changed, as a consequence of the particular arrangement of the pulleys 13*a*, 113*a*, 13*b*, 113*b* and 19, 119, into a direction which has a component which is parallel to the axis of the corresponding pole. The change of direction places the shock-absorbing means 8, 108 in their ideal operating conditions. The stress transmitted from the cable element 7 to the various poles 1, 101 is adequately damped by the springs 22, 122. The compression of the springs 22, 122 also causes an elongation of the portion of the cable element 7 that is affected by the fall, further reducing the jerk transmitted to the worker.

It should be noted that the stress transmitted by the cable element 7 to the various poles 1, 101 during a fall is distributed among the various poles 1, 101 and therefore a reduced stress peak affects each pole.

As a consequence of the shock-absorbing effect provided by the shock-absorbing asorbing means 8, 108, the peaks of the stresses discharged by the cable element 7 onto the poles 1, 101 are reduced, and therefore the poles 1, 101 can effectively support the cable element 7 without requiring an excessive oversizing of the end poles.

Optionally, the end poles, as shown in particular in FIG. 12, can be inclined outwards so as to offer greater resistance to these stresses. In this case, the pole 1, instead of being arranged with its axis 1*a*at right angles to the plane of arrangement of the lower face of the plate 9, 109, lies along an axis which is inclined with respect to the vertical plane that is perpendicular to the lower face of the plate 9, 109.

It should be noted that the poles 1, 101 can be disassembled by fully disengaging the nut 61, 161 from the shaft 40, 140 and then manually extracting the shaft 40, 140 from the female seat 31. The shaft 40, 140 is then assembled manually to the base of the pole 1, 101 before subsequent 15 use of the pole.

If a lateral change of direction of the path followed by the cable element 7 is required, the clamping element 27 arranged on the pole at which the lateral change of direction must occur can be moved to engage the cable element 7 so as to lock it on the intermediate pulley 19.

The clamping element 27 can also be actuated so as to lock the cable element 7 if one intends to isolate, for example during the disassembly of the safety device, a portion of the cable element 7 from the remaining part of the cable element 7.

In practice it has been observed that the device according to the invention fully achieves the intended aim, since by virtue of the change in the direction of the cable element along path portions which have a component parallel to the axis of the poles, and by virtue of the use of the shock-absorbing means, it significantly reduces the peaks of the stresses discharged by the cable element onto the poles, eliminating or in any case reducing the need to oversize the poles.

By virtue of this fact and of the fact that the stresses produced by a fall of a worker are distributed over a plurality of poles, it is possible to produce poles with a structure which can be manufactured at competitive costs yet offers the best assurances in terms of safety.

Another advantage of the device according to the invention is that it allows substantially complete protection of the region to which the device is applied, by virtue of the fact that a direct connection of the cable element to the building is not strictly necessary.

The device thus conceived is susceptible of numerous modifications and variations, all of which are within the scope of the appended claims; all the details may furthermore be replaced with other technically equivalent elements.

In practice, the materials used, as well as the dimensions, may be any according to requirements and to the state of the art.

The disclosures in Italian Patent Application No. MI99A001900 from which this application claims priority are incorporated herein by reference.

What is claimed is:

1. An accident-prevention device for buildings, particularly for assembling prefabricated components made of concrete, comprising at least one pole and connecting means for detachably connecting a base of said pole to a surface of a building; said pole having, proximate to a tip thereof, guiding means for a cable element which forms a safety parapet, wherein said guiding means are adapted to divert, in a direction which is substantially parallel to the axis of said pole, at least part of the stresses transmitted from aid cable element to said pole, and wherein said pole is provided with shock-absorbing means for cushioning the stresses transmitted from said cable element to said pole in a direction which is substantially parallel to the axis of the pole, said guiding means comprising guides for said cable element associated with said main structure of the pole and form, for said cable element, proximate to the tip of the pole, a path portion having a component which is parallel to the axis of the pole; at least one of said guides being fitted on a supporting element which can move with respect to the main structure of the pole in a direction which is substantially parallel to the axis of the pole.

2. The device according to claim 1, wherein said pole comprises a main structure which can be fixed detachably, by way of said connecting means, to the surface of the building; said shock-absorbing means being interposed between said main structure of the pole and said supporting element.

3. The device according to claim 2, wherein said guides comprise two lateral pulleys, which are associated with said main structure of the pole and are arranged so that their axes are parallel and substantially perpendicular to the axis of the pole and are laterally spaced, on opposite sides, with respect to the axis of the pole, and an intermediate pulley, which is fitted on said supporting element; said intermediate pulley being arranged so that its axis is parallel to the axes of said pair of lateral pulleys and being arranged between the pulleys of said pair of lateral pulleys; said intermediate pulley being furthermore spaced from said pair of lateral pulleys in a direction which is substantially parallel to the axis of the pole in order to guide said cable element from said pair of lateral pulleys to said intermediate pulley along two path portions which have a component which is parallel to the axis of the pole.

4. The device according to claim 2, wherein said supporting element is supported by the main structure of the pole so that it can move along the axis of said pole, said shock-absorbing means being interposed between said main structure of the pole and said supporting element.

5. The device according to claim 3, wherein said shock-absorbing means comprise a spring which is interposed between said main structure of the pole and said supporting element.

6. The device according to claim 2, wherein said shock-absorbing means comprise a hydraulic or pneumatic shock absorber which is interposed between said main structure of the pole and said supporting element.

7. The device according to claim 3, wherein said pole is arranged so that its axis is-substantially vertical or inclined with respect to the vertical, said lateral pulleys being arranged at a same height which is greater than the height of said intermediate pulley.

8. The device according to claim 5, wherein said lateral pulleys are each supported, so that they can rotate about their respective axes, by two wings which are associated with a tip element of the pole, said tip element being rigidly coupled to said main structure of the pole.

9. The device according to claim 8, wherein said pair of wings is supported, so that it can rotate about the axis of the pole, by said tip element.

10. The device according to claim 2, wherein said supporting element is supported, so that it can rotate about the axis of the pole, by said main structure of the pole.

11. The device according to claim 8, wherein said supporting element has a sleeve whose axis coincides with the axis of the pole and is coupled, so that it is slideable along its own axis, to a coaxial sliding seat formed in said tip element.

12. The device according to claim 11, further comprising means for delimiting the sliding of said sleeve along said coaxial sliding seat.

13. The device according to claim 11, wherein said spring is fitted around said sleeve and engages, with one of its ends, against a shoulder formed by said supporting element and, with its other end, against a shoulder formed by said tip element around the inlet of said sliding seat.

14. The device according to claim 12, wherein said means for delimiting the sliding of said sleeve along said sliding seat comprise a traction element which is accommodated in said sleeve and connects said tip element and said supporting element, said traction element delimiting the sliding of said sleeve away from said tip element.

15. The device according to claim 3, further comprising securing means for securing the cable element on said supporting element.

16. The device according to claim 15, wherein said securing means comprise a clamping element which can engage a portion of said cable element that engages said intermediate pulley.

17. The device according to claim 2, wherein said main structure of the pole has a shape which tapers from its base toward its tip.

18. The device according to claim 1, wherein said connecting means comprise an anchoring element which can be fixed to said surface of the building and forms a female seat with an access opening formed in said surface; said female seat being arranged along an axis which is substantially perpendicular to said surface of the building and being detachably associable with a male-shaped end of a securing element which protrudes from the base of said main structure of the pole.

19. The device according to claim 18, wherein said female seat has, starting from said access opening, a first portion, through which said male-shaped shaped end can pass with an axial movement with respect to said female seat, and a second portion, which forms at least one axial shoulder which can be engaged by said male-shaped end by virtue of a partial rotation of said securing element about the axis of said female seat and of an axial translatory motion of said locking element in the opposite direction with respect to the direction of insertion with respect to said female seat.

20. The device according to claim 19, wherein said securing element can rotate about the axis of said female seat, with respect to said female seat, through a preset angle for the passage of its male-shaped end from an insertion position, in which it can pass through said first portion of said female seat and move laterally beyond said at least one axial shoulder, to an engagement position, in which it faces, with said male-shaped end, said at least one axial shoulder.

21. The device according to claim 20, wherein said preset angle is an is angle of substantially 90°.

22. The device according to claim 19, wherein said anchoring element comprises a tubular body which internally forms said female seat, said tubular body having an open axial end which forms said access opening and, in an intermediate region of its extension, at least one raised portion which protrudes from its internal surface and covers a limited arc around the axis of said female seat, said at least one raised portion forming said at least one axial shoulder.

23. The device according to claim 22, wherein said tubular body has, starting from said open end, a first portion, whose transverse cross-section has a non-circular shape and is complementary to said male-shaped end of the securing element, and a second portion, which has a substantially cylindrical shape or is shaped like a cylindrical sector or sectors in order to allow said male-shaped end to turn about the axis of said tubular body after passing from said first portion to said second portion; said at least one axial shoulder being formed by the region for transition between said first portion and said second portion.

24. The device according to claim 23, wherein said non-circular shape of said first portion of the tubular body is formed by a deformed portion of said tubular body.

25. The device according to claim 23, wherein said male-shaped end of the securing element comprises a portion of a shaft whose diameter is smaller than the minimum transverse dimension of said first portion of said female seat and is provided with at least one lateral protrusion which can be inserted in said second portion of said female seat and forms at least one axial shoulder which can engage said at least one axial shoulder of the female seat.

26. The device according to claim 25, wherein said shaft has, proximate to one of its axial ends, two lateral protrusions which extend from diametrically opposite regions and form two axial shoulders which constitute said at least one axial shoulder.

27. The device according to claim 18, wherein said anchoring element is embedded in a concrete component so that said access opening is arranged at a face of said component that forms said surface of the building.

28. The device according to claim 18, wherein said securing element is rigidly coupled to said main structure of the pole in the rotation of said main structure of the pole about the axis of said female seat and can move with respect to said main structure of the pole along said female seat.

29. The device according to claim 25, wherein said main structure of the pole has, on its base, a protrusion which can engage a seat formed in said surface of the building only after the insertion of said male-shaped end of the securing element in said female seat and after the transfer of said securing element from said insertion position to said engagement position.

30. The device according to claim 29, wherein said protrusion lies around said male-shaped end and has a shape which is complementary to the shape of said first portion of the female seat.

31. The device according to claim 25, wherein said shaft slidingly passes, with one of its portions, through a passage which crosses said protrusion; said shaft being rigidly coupled, in its rotation about its own axis, to said main structure of the pole.

32. The device according to claim 31, wherein said shaft has a region which can be adjusted so as to move said shaft along its axis with respect to the main structure of the pole.

33. The device according to claim 32, wherein said adjustable region is constituted by a threaded region of said shaft which can engage an adjustment nut which abuts against a shoulder which is rigidly coupled to said main structure of the pole.

34. The device according to claim 33, wherein a base of said main structure of the pole is constituted by a plate which can rest on said surface of the building, said shaft protruding with its upper end, which lies opposite the end that can be inserted in said female seat, from an upper face of said plate; said adjustment nut abutting against a shoulder located on the upper face of said plate.

35. The device according to claim 34, wherein a lower face of said plate, which can rest on said surface of the building, lies on a plane which is perpendicular to the axis of the pole.

36. The device according to claim 34, wherein a lower face of said plate, which can be rested on said surface of the building, lies on a plane which is inclined with respect to a plane which is perpendicular to the axis of the pole.

37. The device according to claim 34, wherein said main structure of the pole comprises sections which rigidly connect said plate to said tip element and are spaced around the axis of the pole.

38. The device according to claim 1, further comprising means for securing one end of the cable element to the main structure of the pole.

39. The device according to claim 3, wherein said pulleys have, on their cylindrical surface, a central guiding groove which is adapted to, partially accommodate said cable element.

40. The device according to claim 39, further comprising means which are adapted to contrast disengagement of said cable element from said pulleys.

41. The device according to claim 8, further comprising means for pre-loading said shock-absorbing means.

42. The device according to claim 41, wherein said pre-loading means comprise an adjustment screw which is arranged so that its axis lies parallel to the axis of the pole; said adjustment screw being supported, so that it can rotate about its own axis, by said tip element of the pole; said adjustment screw engaging said supporting element and being adjustable so as to vary the distance of said intermediate pulley from said lateral pulleys in contrast with, or assisted by, the action of said spring interposed between said supporting element and said tip element of the pole.

43. The device according to claim 1, wherein said main structure of the pole is constituted by a lattice-like box-shaped structure.

44. The device according to claim 25, further comprising means for a forced rotational orientation of said shaft about its own axis with respect to said main structure of the pole.

* * * * *